United States Patent [19]

Baer

[11] 4,068,985

[45] Jan. 17, 1978

[54] ROTARY ENGINE OR PUMP CONSTRUCTION

[76] Inventor: John S. Baer, Schooner Head, Bar Harbor, Maine 04609

[21] Appl. No.: 674,141

[22] Filed: Apr. 6, 1976

[51] Int. Cl.[2] ..... F04C 1/00

[52] U.S. Cl. ..... 418/36; 418/112; 418/159

[58] Field of Search ..... 123/8.47; 418/2, 40, 418/18, 36, 152, 153, 159, 112; 73/23 R

[56] References Cited

U.S. PATENT DOCUMENTS

| | | | |
|---|---|---|---|
| 309,734 | 12/1884 | Oehlmann | 418/36 |
| 1,095,034 | 4/1914 | Sanchez et al. | 418/36 |
| 1,452,125 | 4/1923 | Pont | 123/8.47 |
| 1,458,641 | 6/1923 | Cizek | 123/8.47 |
| 2,709,366 | 5/1955 | Potter | 73/231 R |
| 3,015,283 | 1/1962 | Knipp | 418/153 X |
| 3,203,405 | 8/1965 | Sabet | 418/36 X |
| 3,396,632 | 8/1968 | Leblanc | 418/36 |
| 3,476,056 | 11/1969 | Bright | 418/36 X |
| 3,592,571 | 7/1971 | Drury | 418/36 |
| 3,858,560 | 1/1975 | Harrington | 418/36 X |

FOREIGN PATENT DOCUMENTS

| | | | |
|---|---|---|---|
| 339,021 | 12/1930 | United Kingdom | 418/159 |

*Primary Examiner*—Carlton R. Croyle
*Assistant Examiner*—Michael Koczo, Jr.
*Attorney, Agent, or Firm*—Dorfman, Herrell and Skillman

[57] ABSTRACT

A rotary engine or pump employs a block or housing having a cylindrical cavity along the axis of which extends a cylindrical drive shaft supported on the block to permit rotation thereof. Within the cavity, parallel edge walls axially spaced apart from one another and rotatable relative to the shaft and the cavity define between them the bounds of energy chambers. Between these parallel edge walls are arranged an even number of outwardly directed imperforate movable walls with alternate movable walls being attached to and moving with one of the edge walls and intermediate movable walls being attached to and moving with the other edge wall, such that the edge walls and movable walls, the drive shaft and the cavity walls of the block form a plurality of essentially separate and non-intercommunicating energy chambers between the movable walls. The movable walls of the energy chambers are rotatable about the axis of the shaft and rotate with and, in fact, drive the shaft. Inlet and outlet port means through said block are circumferentially spaced around the circumference of the cylindrical cavity to respectively admit fluid into the successive energy chambers which pass the inlet port means as the movable walls move apart and exhaust fluid from the successive energy chambers which pass the outlet port means as the movable walls close together. The oscillation movement of the walls with respect to the shaft is translated into rotational movement of a planet gear on a radial arm fixed to the drive shaft and driving the arm and the shaft, in turn, by its progressive rotation about a sun gear fixed to the block.

55 Claims, 16 Drawing Figures

Fig. 1
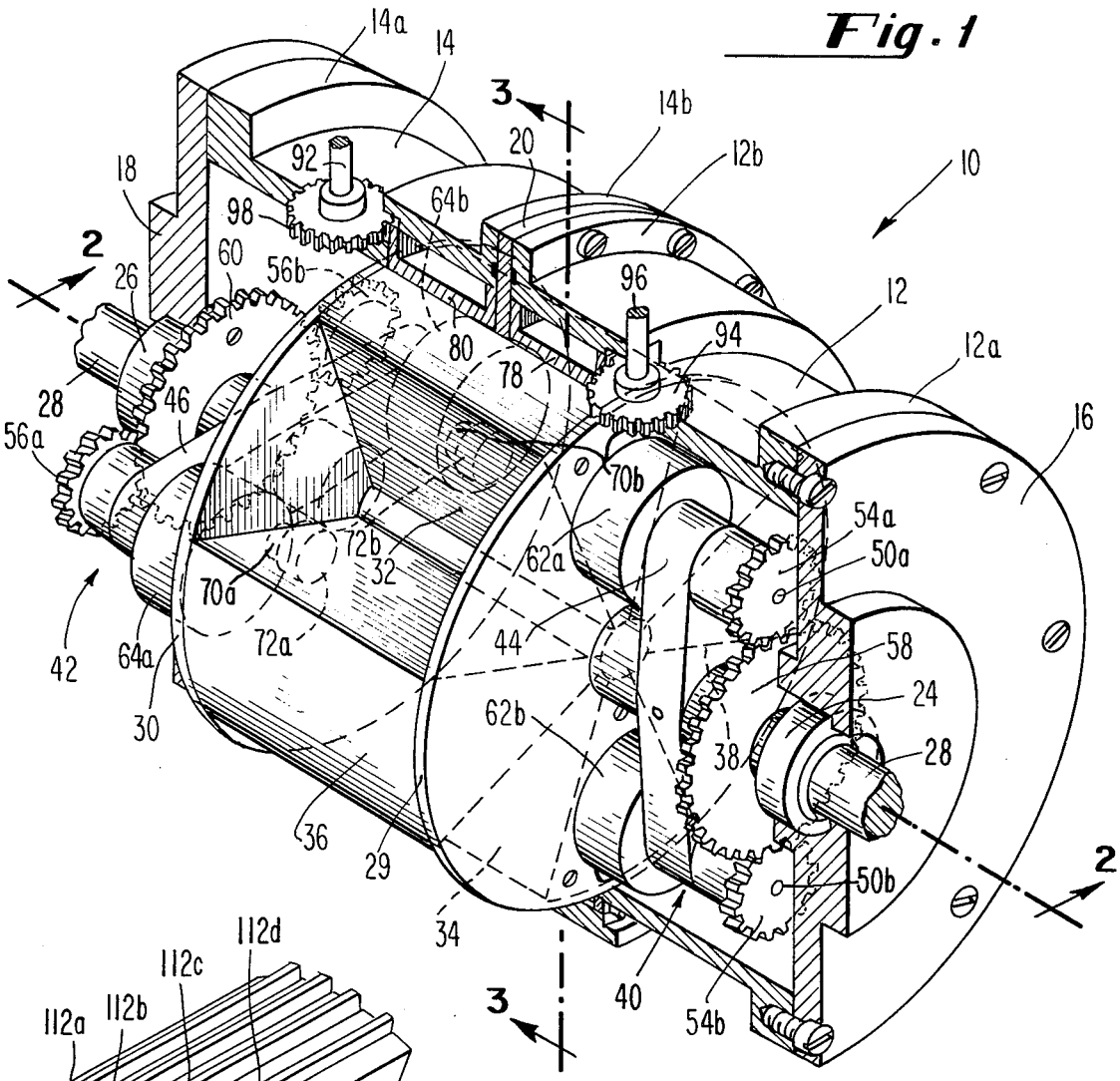
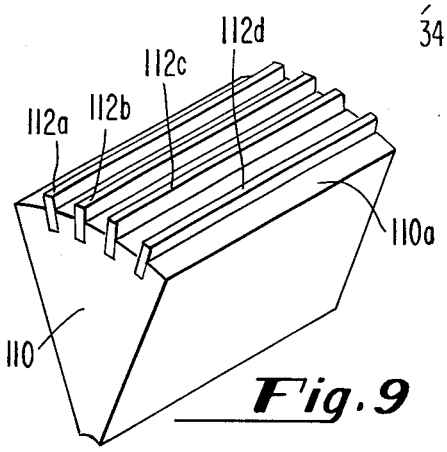
Fig. 9
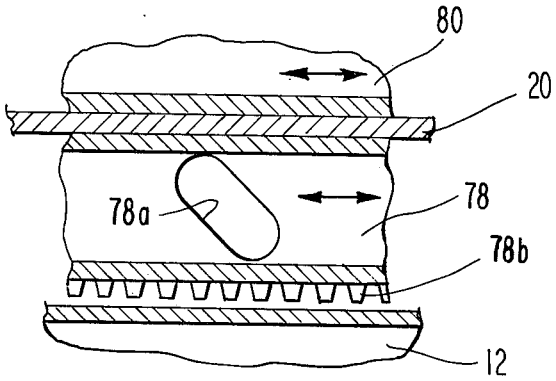
Fig. 4
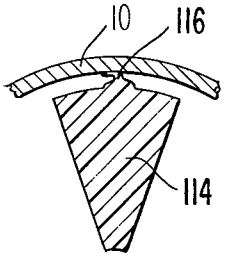
Fig. 10

ROTARY ENGINE OR PUMP CONSTRUCTION

The present invention concerns a novel structural form for a rotary engine or pump having rotating energy chambers whose size is modified by oscillatory movement of symmetrically supported radially extending movable walls toward and away from one another in the course of rotation. The structure is simple in form and symmetrically oriented about the axis of rotation of the drive shaft. It employs translational means to translate the oscillatory movement of the movable walls into a rotational movement to drive the drive shaft.

While rotary engine technology is newer in many respects than piston and cylinder engine technology, the development of the Wankel and similar so-called "rotary" engines has produced a great deal of knowledge about problems which would be common to rotary engines. The present invention is able to employ much of the technology that has been developed in connection with the Wankel or other rotary engines and can use a similar block or housing and some of the sealing techniques, but employs a rotary structure which is radically different in its approach from known "rotary" engines and adds some structural modifications to the block as well. In particular, the present invention employs movable walls which are radially directed and axially oriented to define the bounds of energy chambers in which adjacent walls bounding an energy chamber oscillate toward and away from one another circumferentially around the axis of the drive shaft to change energy chamber size. In the course of oscillation, at some stage, energy is imparted to the movable walls to drive them apart. The driving force provides the primary means of driving the drive shaft through coupling means which translates the oscillating movement of the movable walls into a rotational movement to drive the drive shaft.

Couplings may vary in form but preferred arrangements include a crank connection at a radial extension of the shaft permitting oscillation of each movable wall, edge wall assembly relative to the crank support on the shaft extension. That crank support is a planet gear shaft that carries a pinion which meshes with a sun or ring gear on the housing and, as the crank arm rotates about this gear shaft, it turns the shaft extension and hence the shaft, thus tending to keep rotation smooth and assuring that the movable walls have repeatable patterns of movement which are the same for every rotation. In essence, the motion is a harmonic motion, the nature of which can be varied somewhat, depending on the coupling employed. The coupling is simple and uses conventional techniques relatively easily adapted to the present structure. The parts employed can be rugged and the structure lends itself to design which enables distribution of load and even wear, thereby providing long life. Moreover, the structure permits direct transfer of much of the force directly to the shaft extension rather than through gears with the gears acting primarily to assure proper timing or synchronism.

The symmetrical nature of the engine structure and its movement promotes an even smoother rotational movement than is possible in presently known rotary engines. Furthermore, the expected efficiency of this engine should be high compared to known rotary engines. Seals between relatively movable parts may be made using known rotary engine techniques but the seals are not subject to as severe forces as those in a Wankel engine, for example, and the movable walls may be constructed with broad faces, opposed to the block cavity wall, to permit multiple parallel sealing elements, if desired.

Having the pattern of movable wall movement the same from one revolution to the next, it is possible to precisely predict where each movable wall will lie at each successive shaft position. This, in turn, permits location of fluid inlet and outlet ports on the cavity wall of the housing in proper position to achieve maximum efficiency. The nature of the movable walls makes it unnecessary in most cases to employ valves. Opening and closing of ports is automatically a function of the movement past such ports of movable walls and their associated sealing means. The port is effective for a given energy chamber between the time the leading wall exposes the port and the lagging wall closes it. Timing may become a factor as in any engine or pump and in accordance with the present invention provision is preferably made so that inlet, outlet or both ports may be circumferentially moved relative to the cavity wall to permit optimum timing.

More specifically, a rotary engine in accordance with the present invention includes a block providing a cylindrical cavity. A cylindrical drive shaft is supported on the block coaxially within the cavity to permit rotation of said shaft. Parallel edge walls are located within said cavity axially spaced apart from one another and extending to the cavity wall. These edge walls are rotatable relative to said shaft, but designed to rotate with it, and define between them the bounds of the energy chambers. An even number of outwardly directed imperforate movable walls extend to the cylindrical cavity walls and extend axially between said parallel edge walls with alternate movable walls moving with one edge wall and intermediate movable walls moving with the other edge wall. Essentially separate and nonintercommunicating energy chambers are formed between said movable walls. The movable walls are rotatable about the axis of the drive shaft with the unattached end edge of each movable wall maintaining sliding contact with the edge wall to which it is not attached.

The present invention lends itself to many types of engine and pump applications. When used as an engine it derives its force output at the shaft as the result of force applied in an energy chamber acting to move the movable walls apart. In a hydraulic engine the force of incompressible fluid under pressure produces this effect, with the fluid being drained to sump. In a steam engine the force in expanding steam drives the walls apart after which the spent steam is squeezed out. In the case of a smooth burning fluid fuel, ignition is also required and the resulting explosion forces drive the walls apart. Two or four stroke cycle engines, carburetor or fuel injection techniques, Diesel or spark ignition techniques and many other variables are possibilities. Pump uses may have fewer practical possibilities but at least one of these is a metering pump wherein the output is monitored by the shaft position and rate is monitored by and directly proportional to shaft speed.

For a better understanding of the present invention reference is made to the following drawings in which:

FIG. 1 is a perspective drawing showing a rotary engine of the present invention with its block broken away to show the rotary interior structure;

FIG. 4 is a partial sectional view taken along lines 4—4 of FIG. 3;

FIGS. 7A, 7B, 7C, 7D, 7E, 7F and 7G are diagrammatic showings of the use of the engine as an internal combustion engine in which the movable walls of the engine are shown in successive positions during rotation.

FIG. 9 is a view showing the edge of movable wall provided with a plurality of sealing means; and FIG. 10 is a partial sectional view showing a sealing member which is an integral part of a resinous movable wall.

Figures 2, 3:
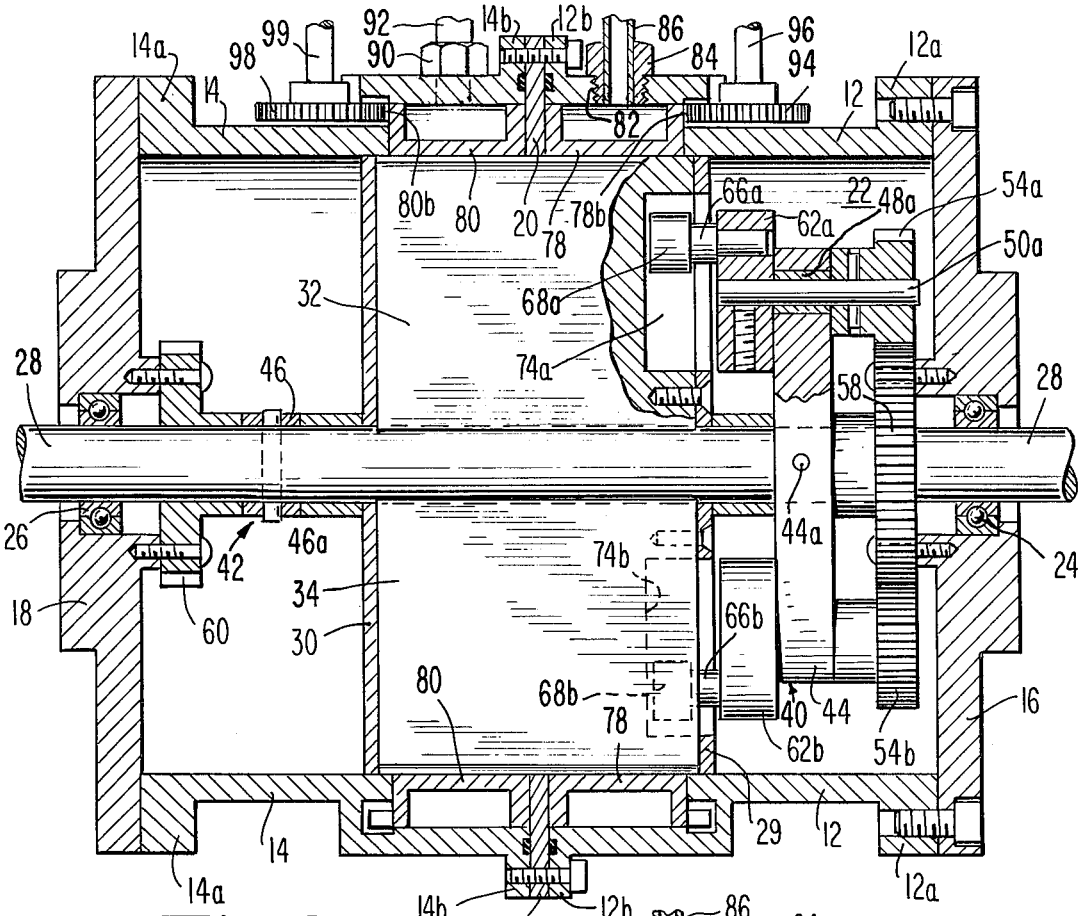
FIG. 2 is a sectional view of the rotary engine taken along lines 2—2 of FIG. 1 with selected parts of the structure shown in elevation with portions thereof broken away and in section.
FIG. 3 is a sectional view taken along lines 3—3 of FIG. 1.

Referring to FIGS. 1 through 5, it will be seen that the engine block, or housing, provides a frame of reference as in other engine structures relative to which other parts of the engine move. The block, generally designated 10, is divided into a pair of similar cylindrical pieces 12 and 14 and generally planar end closures 16 and 18. Circumferential flanges 12*a* and 14*a* enable bolting of the end closures 16 and 18 to the cylindrical pieces 12 and 14, respectively, and cylindrical flanges 12*b* and 14*b* enable the cylindrical pieces to be bolted together with divider ring 20 between them.

Figure 5:
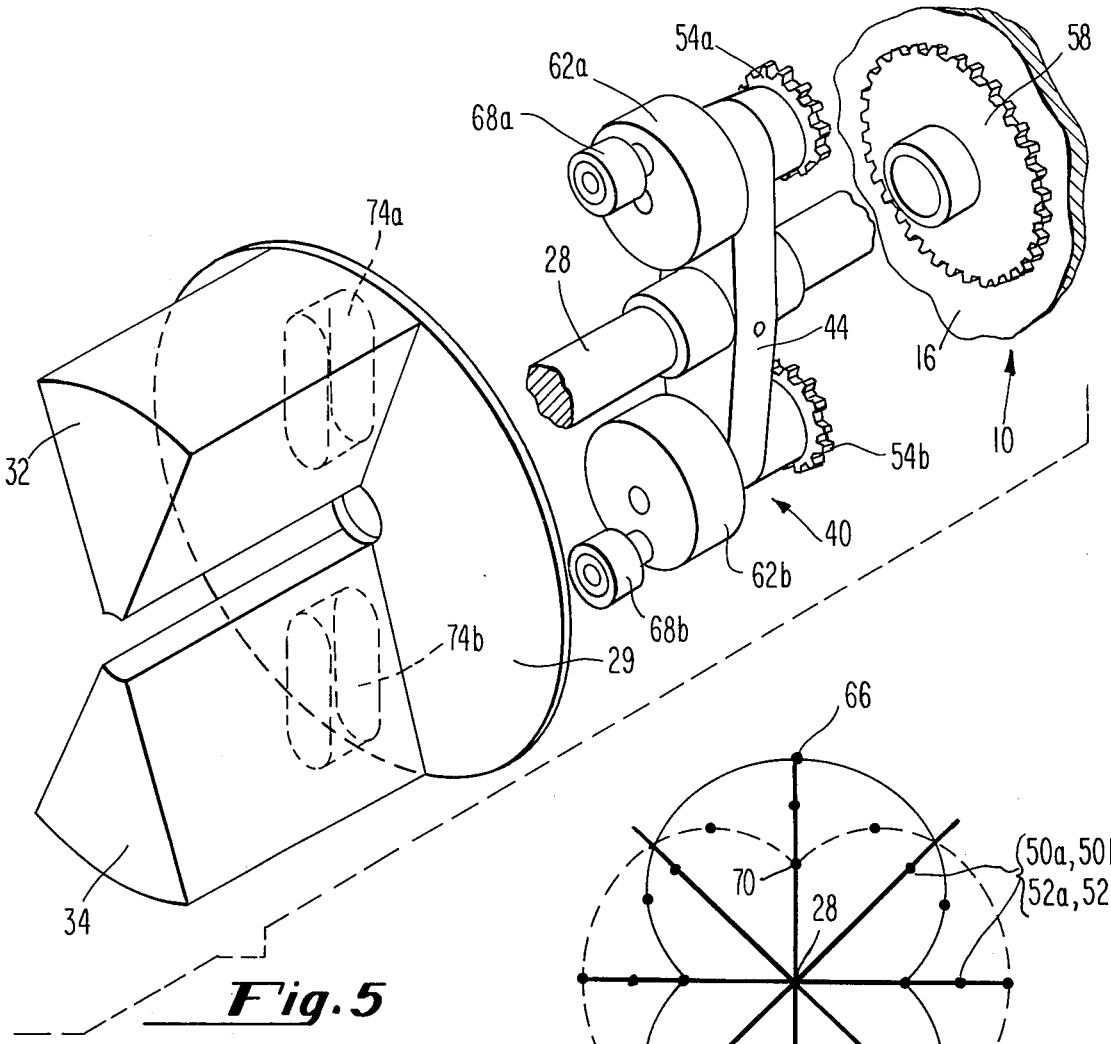
FIG. 5 is an exploded view of half the rotating parts of the rotary engine showing the shaft withdrawn from the sun gear and structure coupling to the wall portion withdrawn from that wall portion.

Within block 10 is a cylindrical cavity or bore 22 in which the rotating parts of the engine are housed. The cavity 22 is preferably a right circular cylinder in form. The end closures 16 and 18 support bearings 24, 26, respectively, which, in turn, support drive shaft 28 which passes through the cylindrical cavity 22 along its axis. Energy chambers within the cylindrical cavity at its axial center are bounded and defined by the walls of the cylindrical cavity, the shaft and two similar but oppositely oriented wall structure subassemblies. In the preferred structure shown, each of these wall subassemblies consists of an edge wall and a pair of movable walls (see FIG. 5). The edge walls 29 and 30 are each generally circular in shape and preferably thick flat discs and are oriented coaxially on the drive shaft. While they normally move with the shaft, the edge walls 29 and 30 are rotatable relative to the drive shaft 28. In the embodiment shown, the edge walls extend outwardly from the shaft to the bounding wall of the housing defining the cylindrical cavity 22. The edge walls 29 and 30 are parallel to one another and define the bounds axially of the energy chambers. In the configuration shown, attached to each of the edge walls, and mechanically forming an integral part of and moving with the edge walls, are a pair of movable walls which, like the edge walls, are imperforate in their extent from the shaft to the cavity wall and from the edge wall to which they are attached to the outer edge wall with which they make sliding movement. Specifically, the two alternate movble walls 32 and 34 are attached to edge wall 29 (providing a movable wall assembly, as seen in FIG. 5) and the two intermediate movable walls 36 and 38 are attached to edge wall 30 to form a second movable wall assembly. Expressed another way, movable walls attached to one edge wall alternate with movable walls attached to the other edge wall.

It will be clear to those skilled in the art that the form of the structure shown is illustrative and may be subject to wide variation. It is possible that in another application, the number of movable walls employed might vary provided that their are always an even number with alternate and intermediate movable walls, respectively, being attached at opposite ends to different edge walls. The edge walls themselves might take other forms and the shape of the movable walls might be considerably varied. It is even possible that instead of edge walls as shown, extensions of the movable walls closing against adjacent movable walls in a sliding relationship, or any other suitable way of forming an enclosed and isolated energy chamber between adjacent movable walls might be substituted.

The edge and movable wall piece assemblies, as shown in FIG. 5, must be coupled to the shaft to drive the shaft through suitable coupling means. As shown in FIG. 2, this is preferably done by connecting edge wall 29 and its connected movable walls 32 and 34 through coupling structure, generally designated 40, to shaft 28. Coupling structure 40 is located at one end of the cavity 22 axially outside of the energy chambers. Edge wall 30 and its connected movable walls 36 and 38 are coupled to the shaft 28 through the other coupling structure 42 at the other end of the cavity 22 outside the energy chambers. It will be observed that the coupling structures, like the movable wall sub-assemblies, are preferably identical to one another and designed to run in this particular construction 90° out-of-phase with one another. At each end, rigid extension means effectively extending the shaft radially outward is required. In this particular embodiment, the coupler structure is mounted on a single linear mechanical arm extending equal distances both sides of the shaft and sufficiently heavy and of sufficient strength to take the forces involved. Each of the respective arms 44 and 46 extends equal distances on each side of the drive shaft 28. Arms 44 and 46 are pinned or otherwise rigidly fixed to shaft 28 by suitable means 44*a* and 46*a*, respectively, (FIG. 2) assuring that the arm moves at all times with the shaft and forms an extension thereof and maintaining their 90° separation from one another.

It will be clear that in other embodiments, shaft extension means could be of an entirely different form, including a wheel of perforate or imperforate form. Furthermore, a single arm extending radially out one side of the shaft will work. However, the symmetrical structure shown preserves better balance, tends to divide the load and, therefore, tends to be less subject to rapid wear than a single radial arm. Mounted in suitable bearings 48*a* in arm 44 are identical gear shafts 50*a* and 50*b* each having its axis parallel to the axis of the drive shaft 28 and equally spaced radially therefrom. Gear shafts 52*a* and 52*b*, respectively, in arm 46 are not shown but their positions may be inferred. Gear shafts 50*a* and 50*b* carry planetary gears 54*a* and 54*b*. Similar gear shafts 52*a* and 52*b*, in similar bearings the arm 46 carry planetary gears 56*a* and 56*b*. Each of the gear assemblies is identical to the others, is pinned or otherwise fixed to its gear shaft on the side of the arms 44 and 46, respectively, axially removed from the energy chambers in position such that the planetary gears 54*a* and 54*b* engage sun gear 58. Sun gear 58 is fixed to the end closure 16 of block 10 so that planetary gears 54*a* and 54b must revolve around it. Similarly, sun gear 60 is fixed to end closure 18 causing planet gears 56a and 56b to revolve around it. In this particular embodiment the sun gears have twice as many teeth as each of the planetary gears. It will be clear to those skilled in the art that in some embodiments of the invention a stationary ring gear could be used in place of the sun gear.

Fixed by suitable means to the gear support shafts 50a and 50b, axially on the opposite side of the arm 44 from the gears, are eccentrics 62a and 62b. Similar crank arm members provided by eccentrics 64a and 64b, are fixed to the gear shafts 52a and 52b. Completing the crank structure are drive eccentric crank pins 66a and 66b supported in the crank arms 62a and 62b, respectively, and, in turn, rotatably supporting drive bushings or bearings 68a and 68b. Similarly, drive eccentric crank pins 70a and 70b on crank arms 64a and 64b rotatably support bushings or bearings 72a and 72b. These crank pins and bushings extend parallel to the gear shaft 50a. The rotatable bushings 68a and 68b, 72a and 72b, on their respective drive crank pins, extend into the movable wall structure in this particular embodiment, preferably into closely confining radially extending slots 74a and 74b, 76a and 76b, respectively, which slots are sufficiently long to accommodate the total radial component of movement of these bushings and supporting crank pins. (See discussion below of FIG. 6.) As seen in FIG. 2, the design is such that each of the bushings on a particular arm lies in the corresponding end of each slot at the same time. In FIG. 2 the pin bushings 68a and 68b are shown simultaneously in the outer ends of their respective slots 74a and 74b. In FIG. 3 pin bushings 72a and 72 are shown simultaneously in the inner ends of their respective slots 76a and 76b. Due to the symmetry of the structure the respective pin bushings will arrive at the opposite ends of their respective slots simultaneously, as well, when shaft 28 has rotated 90°. The crank mechanism, therefore, provides a translation element for effectively translating the lateral or arcuate oscillation movement of the movable walls into a rotational movement of the shafts of gears 54a, 54b, 56a and 56b. Because sun gears 58 and 60 are both fixed, movement of the walls causes a progression of the planet gears 54a, 54b and 56a, 56b around their sun gears, which, in turn, drives the arm extensions 44 and 46 rotationally in alternation but in the same direction and, therefore, drives rotationally the shaft 28 to which the arms are pinned. In the example illustrated, it is necessary for the sun gear to have two times as many teeth as a planet gear in order for the resultant movement of two complete cycles of the cranks to cause the main shaft to turn one full revolution.

In addition to modifications using other gear arrangements and shaft extension means, it is possible to construct engines in accordance with the present invention using chains and sprockets or timing gears and belts in place of gears. In fact, any positive means of transfer of motion might conceivably be used in certain applications.

In any type of engine or pump arrangement contemplated by the present invention, fluid must be introduced into the energy chamber region through some sort of inlet port and must be exhausted through some sort of an outlet port. These ports may be openings through the walls of a housing of simple or complex shape. They may be connected to whatever type of apparatus is needed for generating the selected fluid condition for a given mode of operation and for moving the fluid toward or away from a port in the engine cavity. In all cases the inlet port and the outlet ports are circumferentially displaced from one another with the inlet port occurring in the direction of rotation prior to the outlet port. In some cases more than one inlet and more than one outlet port may be provided. In other cases inlet ports and outlet ports may be repeated at different circumferential locations around the cavity.

Whatever the port configuration arrangement, it is often desirable that a port be repositionable circumferentially in order to control the effect of timing upon the engine. In the embodiment shown in the drawings, the cylindrical wall members 12 and 14 are not of uniform diameter, but are provided with two diameter sections, the larger of which is provided beneath the flanges 12b and 14b and adjacent to the divider ring 20. The divider ring itself preferably has the same inner diameter as the smaller diameter portions. The larger diameter portion is provided to accommodate snugly ring channels 78 and 80, respectively. Ring channels 78 and 80 are identical and provide outwardly facing channels of "U" cross-section, as seen, for example, in FIG. 2. The inside surface of the bottom of the channels is cylindrical and of the same diameter as the smaller diameter portion of the cylinder walls 12 and 14, and the ring channels are preferably adapted to fit snugly against the shoulder at the end of the smaller diameter portion which serves as a stop. The channels are also of such an axial width dimension that they extend to the divider ring 20 so that in assembly, as shown in FIG. 2, the entire structure presents a smooth continuous diameter cavity 22, at least across the width of the energy chambers. An inlet port 78a into the energy chambers is provided through the bottom of channel 78, for example, as seen in FIG. 3. An outlet port 80a is seen as offset circumferentially from inlet port 78a. Each of these ports communicates, respectively, through its channels to an opening through cylindrical housing sections 12 or 14, respectively. For example, through cylindrical housing wall 12 extends a threaded opening 82 which receives a threaded nut 84 holding tubing 86 communicating with the fluid supply (not shown). Similarly, a threaded outlet port from the channel 80 through cylindrical housing wall 14 receives a threaded nut 90 holding tubing 92 in place, the tubing leading, in turn, to suitable exhaust means (not shown). Some of the complexity in certain parts probably can be greatly simplified by careful design.

The purpose of providing circumferential channels providing ports into and out of the energy chambers is to permit repositioning of the ports 78a and 80a. This can be accomplished in various ways, but, in accordance with the disclosed embodiment, each of the channels is provided with a ring of gear teeth 78b, 80b, on the outer sidewall of its channel and projecting axially outward generally parallel to the axis to provide a toothed rack. Cooperating with the rack 78 is a pinion 94 supported on and rotated by a radially directed shaft 96 with respect to the cylindrical housing wall 12 so that the pinion's teeth engage the rack. A similarly arranged pinion 88 rotated by shaft 99 engages and drives rack teeth 80b. In each case rotation of the pinion 94, 98 will drive the rack 78b, 80b and cause rotation of the channel 78, 80 with respect to the housing, relative to which is is snugly retained. This rotational movement enables repositioning of the ports 68a, 70a to whatever circumferential position may be advantageous in a particular application.

Because the ports may be traversed by sealing means on the outer edges of the movable wall members, it is sometimes preferable to provide them with a smooth, elongated, out-of-round shape, such as shown in FIG. 4, in order to minimize the effect of wear. It will be clear that the selected port size and shape will depend upon a given design, and where desirable, nozzle or other orifice modifications, or additions to the orifice, may be employed, as desired. Valves, although preferably and advantageously eliminated, may be employed in various shapes and forms as required in connection with ports in a particular application. It will also be apparent that the ring channels, while of particular advantage, need not be provided in the form shown which permits repositioning through 360°. Very often only a small arcuate section of the circumference need be covered. A segment of a ring in channel form and having closed ends provided with suitable sealing means might be employed instead of the complete ring. Non-arcuate movable pieces might also be employed in a given application and considerable variation could be provided in the means of moving various ports. To have the ports arranged so that they may be moved manually or automatically from the outside, of course, is a major advantage avoiding the need to disassemble the machine to change its timing. The geared nature of the device shown will also hold the channels in a position, once selected. However, if a position changing device does not provide it, separate stop means will have to be employed to hold the port in selected position. Other means of adjusting port positions without disassembly are contemplated as is the simple ability to change port position by disassembly loosening the port carrying piece and reassembling, for example, thereby locking the piece in its newly selected position.

Figure 6:
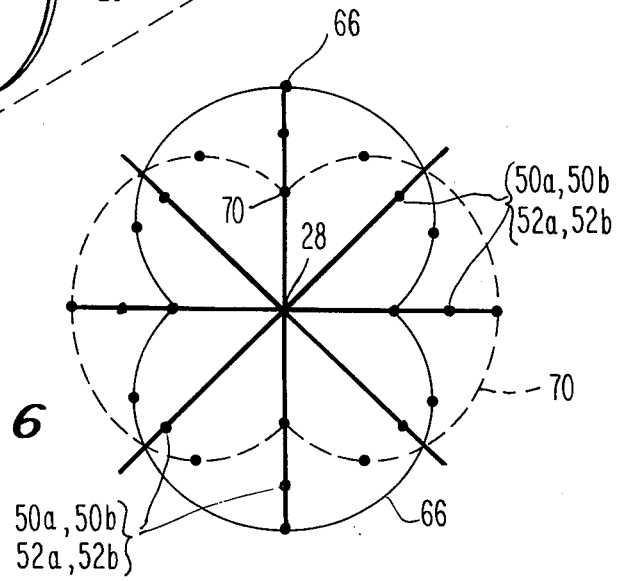
FIG. 6 is a diagram showing the driven crank pins' positions at eight successive equal time intervals representative of a total shaft rotation.

The diagram of FIG. 6 is provided as an aid to understanding the force and motion transfer mechanism. Solid radial or diametrical lines through the axis at eight equal angular intervals represent selected positions of the respective arms 42 and 44, and the circles therealong at equal radii from axis 28 represent successive positions of each of the gear shafts 50*a*, 50*b*, 52*a* and 52*b*. Since it will be understood that the view represents in effect an axial view similar to FIG. 2, or more properly, a projection onto a common plane along the axis showing pin and shaft extending arm positions superimposed in that common plane. Since the pinion gear shafts are all at the same radius, their coincidence in the projection can be readily understood. It will be understood, however, that, since the arms 44 and 42 are in reality 90° out-of-phase with one another, the positions of their crank pins 66*a* and 66*b* for arm 44 and 70*a* and 70*b* for arm 42 will differ. Since pins 66*a* and 66*b* travel the same path represented by the solid line, a common designation 66 will be understood to designate the solid line path, including the eight designated successive pin positions. Similarly, a common designation 70 is used for the dashed line path of crank pins 70*a* or 70*b*. Considering crank pin path 66, for example, it will be observed that in a full revolution of shaft 28, crank pin 66 moves from a maximum radius in line with its arm to a minimum radius in line with its arm back to a maximum radius and back to a minimum radius. The change in radius is, of course, two times the length of the crank arm. It will also be observed that in the intermediate positions shown the crank pin achieves the same radius as the gear shaft, but it is offset to one side at the full length of the crank arm, thus producing a pattern of movement somewhat like the figure traced in solid lines. The same observations apply to crank pin path 70.

If one bears in mind that the movable walls are effectively attached to the crank pins 66 and 70 insofar as circumferential position is concerned, it becomes possible to visualize movable wall positions relative to arms 42 and 44. Thus it is possible to visualize the walls oscillating in position from positions a crank's length ahead of the shaft-extending arms 44 and 46 to positions a crank's length behind the arms and back again. Two full oscillations occur each revolution of shaft 28. With the arms positioned 90° out-of-phase, the walls connected to one arm move in the opposite direction from the walls connected to the other arm. This causes the walls to appear to alternately move toward and away from one another, first increasing and then decreasing the size of the chamber between the adjacent walls.

In certain parts of the path, wall movement is fast relative to the speed of the arm movement, and in other parts the wall movement speed is slow relative to the speed of the arm movement. The net effect is that sometimes the movable walls appear to nearly stop movement and at other times they accelerate where the distance which must be traveled is greater than the distance traveled by the gear shaft. Twice each revolution the crank pin and its walls reach a minimum speed and almost stand still as the crank pin reverses direction. It will be observed that, when the wall is in one of these minimum speed positions, crank pin movement is primarily radial movement and there can be relatively little transfer of force. On the other hand, there can be direct transfer of force in the opposite situation where the main component of motion of the arm may be effectively slower. The pattern of movement is a function of the gearing, crank dimensions, slot shape and relative placement of the shaft extending arms, and is predetermined for a given system. Functional use of the predetermined movement and relative positioning of the movable walls, as well as the variable design of such movement, is a basic consideration in designing a given engine or pump for a particular type of application. For example, variation from the straight radial slot can give variations in movement patter which may prove highly advantageous in a given application.

The structure, as described thus far, could be used for a variety of types of engine and pumps. The different applications would, of course, call for use of various types of fluid, as well as different operations of the fluid upon the structure, leading to varying positions for the inlet and outlet ports and possibly variations in port design. In addition, the auxiliary equipment used with the engine would, of course, differ radically from one situation to another.

The structure was first conceived as an internal combustion engine. With such use the fluid is ordinarily a combustible vapor consisting of a mixture of air and fuel particles such as vaporized gasoline. This fluid may be supplied to the inlet port of the engine in a manner similar to and using equipment conventionally employed in an internal combustion engine for an automobile. That is, fuel may be fed in the same way to a carburetor wherein it is mixed with predetermined amounts of air and provided access or ducting to the inlet port.

The location of the inlet port is of some critical importance in an internal combustion engine and, hence, the repositionability of the port may be of great importance in such an application. Generaly speaking, however, the introduction of the air/gas mixture needs to be at a time when the movable walls of the energy chambers are separating so that the chamber is being enlarged which action creates a partial vacuum which will tend to draw the fuel into the energy chamber.

The FIGS. 7A through 7F illustrate various stages in a four-stroke cycle version of an Otto cycle type internal combustion engine employing ignition means such as a spark plug 100 to produce an explosion of the fuel (i.e., air and gasoline mixture) within the confined walls to drive the walls apart and provide the force necessary to move the shaft through the coupling, as previously explained.

Figure 7A:
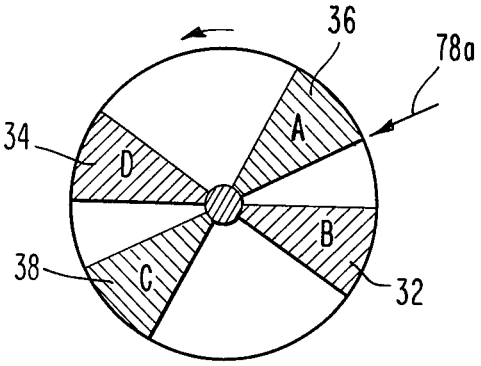

Referring to FIG. 7A in the diagram shown, the view is similar to that shown in FIG. 3. While in these diagrammatic showings the movable walls are labeled A, B, C and D, walls corresponding to those shown in FIG. 3, for example, might be as follows: movable wall 36 corresponds to wall A; movable wall 32 to wall B; movable wall 38 to wall C; and movable wall 34 to wall D. These diagrams are used herein to describe the effects occurring between the movable walls A and B in the course of a revolution, it being understood that the space between each of the movable walls experiences exactly the same kind of sequence, but in different phasing. The action of the engine and the transfer mechanism makes possible four simultaneously occurring processes in the different energy chambers, each of which lags the chamber ahead of it by 90°.

Figure 7B:
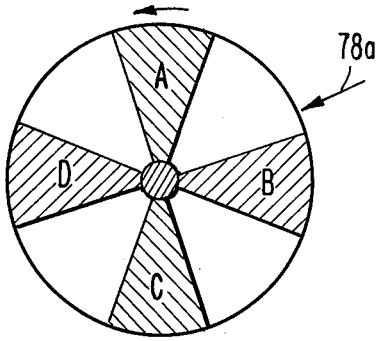
Figure 7C:
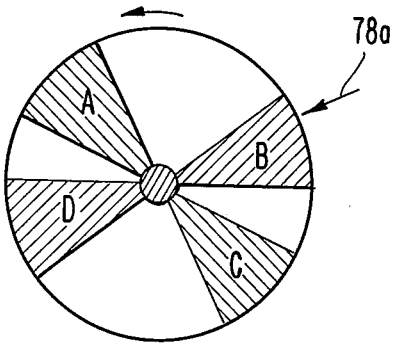
Figure 7D:
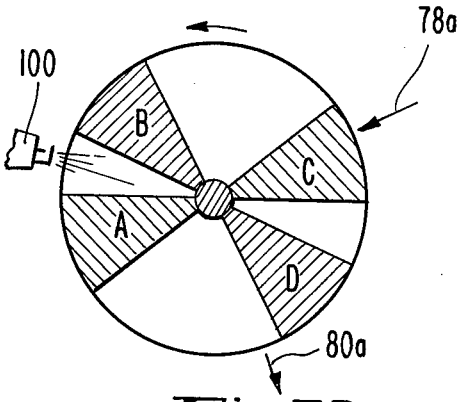

Referring first to FIG. 7A, it will be seen that as movable wall A passes the intake port 68*a*, that port is opened to the energy chamber between walls A and B. The timing of the wall movement is arranged such that as wall A passes intake port 68*a* it will tend to move much more rapidly than wall B, so that the net effect is for the chamber size to expand. Such expansion, in turn, tends to create a partial vacuum drawing fuel into the constantly enlarging space, as illustrated in FIG. 7B. Ultimately the walls must begin to move together again and the wall B moves over the intake port 68*a* to seal it off, as shown in FIG. 7C, before compression begins by rapid movement of wall B toward wall A to compress the fuel in the compression phase of the four cycle program. As compression is completed, or about to be completed, as seen in FIG. 7D, the chamber passes the spark plug 100 which is ignited. Exact timing as in the other engines of this type may be either just immediately before or at, or slightly after, the minimum size of the energy chamber between walls A and B has occurred.

Figure 7E:
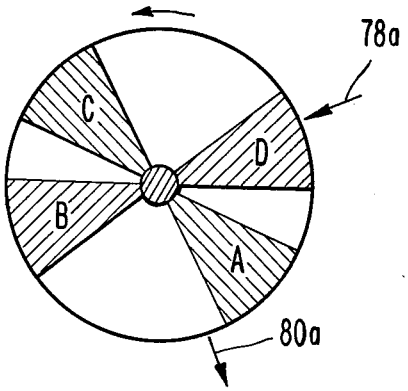
Figure 7F:
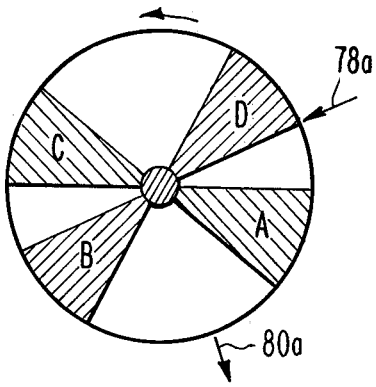

The effect of the firing of spark plug 100 is to cause explosion of the fuel which will drive wall A away from wall B because of the nature of the gear action and crank pin positions at this point which permits free movement of wall A, but not of wall B. The crank pin and crank arm positions relative to driven movable wall A in this position is also such that the force of the explosion will drive the arm 46, effectively transmitting the force directly through the pin and crank connections, rather than through the gears. Before the position of FIG. 7E is reached most of the force from wall A has been transmitted to the arm 42 and, as shown, wall B is in position to, in turn, transmit force through arm 44 to the shaft. As seen in FIG. 7F, after the wall A passes and exposes the exhaust port, wall B begins to close into wall A narrowing the energy chamber and forcing the exhaust from the explosion through the exhaust port 70A. The exhaust port may, of course, be connected to an exhaust system similar to that employed in automobiles or other internal combustion engine systems.

Following the cycle shown the same cycle is repeated. Of course, as previously indicated there are four energy chambers, all corresponding to cylinders in a conventional internal combustion engine, each going through the same cycle but at 90° intervals. The motion described for the chamber between walls A and B repeats for B and C, C and D, and D and E in succession, providing the same positioning of each of those energy chambers relative to the intake port, the ignition means and the exhaust port. Thus, at four different times during each revolution of shaft 28 force is transferred to the shaft from each of the four walls in succession as it is driven by explosion. At all other times it is the walls which are moved by some of that force fed back into the system by way of the gear system.

The spark plug 100 may be supported within the cavity on divider ring 15, or some other portion of the housing 10 relative to which the inlet and outlet ports are movable. Wherever supported, it should be recessed from the cylindrical surface of the cavity in order to avoid interference with the movable walls or other portion of the rotor or its sealing means. Electrical ignition means of a suitable known type may be used to fire the spark plug.

It will also be appreciated that the design details depend on application. The engine can be designed for compression ignition as well as spark ignition. An appropriate Diesel cycle could be used. Design of a two cycle system requires design of suitable scavaging techniques.

Figure 8A:
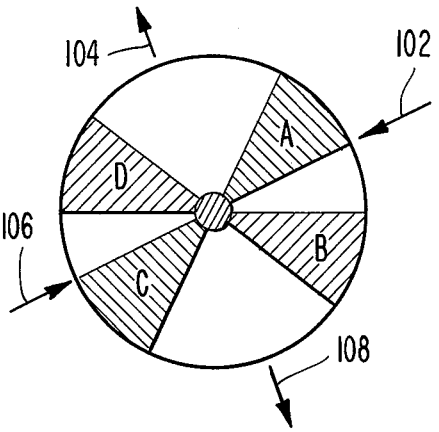
FIGS. 8A and 8B are diagrammatic showings of the use of the machine somewhat modified as a steam or hydraulic motor or as a metering pump.
Figure 8B:
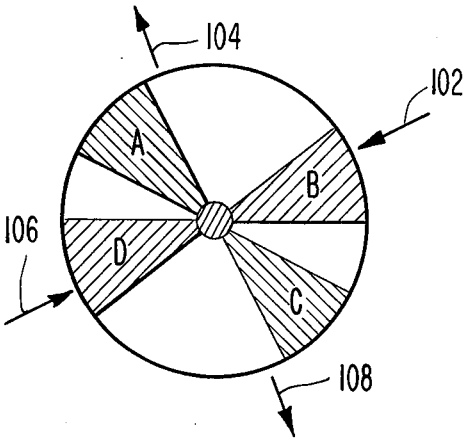

FIGS. 8A and 8B show an engine using the same mechanism which employs input and output ports, but uses no ignition means. Because there is no requirement of compression and ignition of the fuel, this system involves only two cycles. A feeding in of the fluid which, when permitted, tends to drive the walls apart and an exhaust of the fluid, once the walls have been driven apart, as the walls are closed back toward one another comprise the only two cycles required. As seen in FIGS. 8A and 8B, such a two-cycle system permits the doubling-up of cycles, or two full two cycles, with the rotor construction shown.

More specifically, with the engine used as a steam engine, the inlet port may be provided at approximately the same position. When the movable wall A passes the port 102, steam is permitted entry into the energy chamber between walls A and B. The energy inherent in the steam causes the steam to expand and, in doing so, drives walls A and B apart. When wall B closes off the inlet port, however, no further steam can enter. Wall A shortly, thereafter, exposes outlet port 104, which may be connected to a system for venting the steam to atmosphere. As the wall B closes down toward wall A it drives the steam out of the compartment. Shortly, thereafter, wall A passes inlet port 106 exposing it to the energy chamber between walls A and B. Again, the input of the steam into that compartment and the addition of steam as well as the expansion of the live steam will cause wall A to be driven away from wall B. During the latter part of the period of greatest expansion the inlet opening is closed. Meantime, outlet opening 108 is opened by the passing of wall A to permit the steam to be squeezed out as wall B closes toward the wall A. Again, the cycle is repeated.

Although steam is a compressible fluid, it will be readily apparent to one skilled in the art that the engine without ignition means need not be confined to a steam engine, but even incompressible fluids, such as water or oil, can be used. In such cases pressure produced by pump or other means is used to supply the fluid under pressure, which due to its incompressible nature will cause the walls between which it is fed to be driven apart. Again, when the outlet is exposed, if the vent is to atmosphere the squeezing down of the compartment by the movement of the chamber walls together will cause the fluid to be forced out. Again, a second full cycle can be repeated during the other half of revolution.

Of course, instead of using the machine of the present invention as an engine, it is possible to use it as a metering pump. For example, as incompressible fluid is fed through such a metering pump, it experiences a cycle similar to that described in its use as an engine, except that instead of using the shaft to drive a load, the shaft in such a case is used merely as a means of measurement. The speed of the shaft rotation in such an instance is directly proportional to the pressure and is a measure of the volume of material.

The matter of sealing the individual firing chambers from one another and maintaining good sealing contact between the cavity and moving walls is a matter of known technology in Wankel engines, and other rotary engines. This technology may be adapted, as needed, for application to the present invention. The greatst rotational speeds are encountered in the interface between the engine block and the rotor parts which simultaneously move relative to one another, so that the most severe problems to be encountered can be solved by the Wankel technology. FIG. 9, for example, shows a movable wall 110 carrying in its broad arcuate outer surface a plurality of sealing elements 112*a*, 112*b*, 112*c* and 112*d* which may be of a type known through Wankel technology. Thus the movable wall being broad at its outer edge in contrast to the narrow edge in the Wankel can provide more sealing elements, as shown, or use other techniques to achive a better seal. Less severe problems of relative movement, of course, are encountered between the moving wall assemblies and the shaft and between one set of moving walls and the other edge wall but lubrication and sealing problems are within the skill of known engine technology. In fact, in applications where incompressible fluid is employed and heats encountered are not severe, as compared with internal combustion engines, materials selected for parts may be made of molded resins or other materials not commonly encountered in engine technology. In such event, the present invention contemplates the use of integral sealing means in some cases. FIG. 10 illustrates one such possibility wherein each movable wall 114 is cast of resinous material with at least one integral sealing element 116 formed in such a way that it remains relatively resilient and flexible despite hardening of the rest of the movable wall 114. The sealing element in assembled position will be resiliently displaced from an unstressed radially outwardly extending position to the position shown in FIG. 10 upon assembly against the housing wall 10. Modern plastic technology permits hardening of certain parts of a cast or extruded body and rendering flexible other parts. Sealing parts may be formed of flexible portions and in some applications may be thin flexible webs actually intended to be bent to accomplish sealing, as illustrated in FIG. 10, although separate sealing elements may alternatively be used.

Various modifications to the preferred embodiment shown and described have been discussed. Other modifications and variations will occur to those skilled in the art. All such modifications and variations within the scope of the claims and intended to be within the scope and spirit of the present invention.

I claim:

1. A rotary engine construction comprising:

a housing providing a cylindrical cavity within and defined by cavity walls, a drive shaft extending coaxially through said cylindrical cavity supported by the housing on the axis of the cavity in suitable bearings permitting rotation thereof, an even number of imperforate movable walls extending at least between said shaft and said cavity wall such that alternate movable walls are mechanically connected to move together in a first assembly and intermediate movable walls are mechanically connected to move together in a second assembly, sealing structures on said first and second assemblies such that the spaces between the respective movable walls form energy chambers which are mutually isolated from one another, separate drive coupling means respectively between points on each of said first and second assemblies spaced radially outwardly from the shaft and an associated rigid radial extension from the shaft outside the energy chambers, each respective coupling means including means permitting oscillatory movement of the respective assembly relative to said rigid radial extension and timing means associated with each of the drive coupling means to assure a predetermined phasing in the movement of the movable walls relative to one another such that an integral number of oscillatory cycles occurs each full revolution of each movable wall, whereby each said coupling means is arranged to accommodate out-of-phase movements of said movable walls so that said oscillatory movement of said walls does not interfere with transmission of rotational movement to said shaft and energy from the walls is transmitted directly to the shaft, inlet port means through the housing positioned in a wall of said cylindrical cavity to permit fluid to flow into the successive energy chambers as the walls move apart, and outlet port means through the housing positioned in a wall of said cylindrical cavity, to permit fluid to be expelled from the successive energy chambers as the walls close together.

2. The engine of claim 1 in which there are four movable walls defining four energy chambers between them.

3. The engine of claim 2 in which there are two sets of inlet port means and two sets of outlet port means spaced alternately around the circumference of the cylindrical chamber.

4. The engine of claim 1 in which there are as many inlet port means and as many outlet port means, respectively, as there are movable walls in both of the first and second assemblies with the inlet port means and outlet port means alternating around the circumference of the cylindrical cavity in the aforesaid effective positions.

5. The engine of claim 1 in which two full cycles or four strokes are provided and in which inlet port means is positioned at a position where the movable walls start to separate and outlet port means is positioned to lie at the position where the movable walls close together for the second time after passing the inlet port means.

6. The engine of claim 5 in which ignition means is interposed between the inlet and outlet port means in position to fire a combustible fuel to drive the movable walls apart.

7. The engine of claim 1 in which a suitable system for feeding fluid to the inlet port means and a suitable system for removing fluid from the outlet port means are provided and coupled to said respective port means.

8. The engine system of claim 7 in which the system for feeding fluid to the inlet port supplies incompressible fluid and the inlet port means and the outlet port means is so positioned that the incompressible fluid is forced out of the energy chambers the next time the movable walls move together after they are urged apart by fluid entering the inlet port means.

9. The engine system of claim 7 in which the system for feeding fluid to the inlet port supplies compressible fluid.

10. The engine system of claim 9 in which the system for feeding fluid supplies a compressible fluid from which energy can be derived from expansion of the fluid within an energy chamber.

11. The engine system of claim 10 in which the system for feeding compressible fluid supplies steam.

12. The engine system of claim 9 in which the system for feeding compressible fluid supplies combustible mixture and in which ignition is employed within the energy chambers of the engine.

13. The engine system of claim 12 in which the engine employs ignition means supported in the cylindrical cavity on the housing wall in position to ignite the fluid mixture in each energy chamber at a point where the walls are able to move apart.

14. A rotary fluid metering pump comprising:

a housing providing a cylindrical cavity within and defined by cavity walls, a drive shaft extending coaxially through said cylindrical cavity supported by the housing on the axis of the cavity in suitable bearings permitting rotation thereof, an even number of imperforate movable walls extending at least between said shaft and said cavity wall such that alternate movable walls are mechanically connected to move together in a first assembly and intermediate movable walls are mechanically connected to move together in a second assembly, sealing structure on said first and second assemblies such that the spaces between the respective movable walls form energy chambers which are mutually isolated from one another, separate drive coupling means respectively between points on each of said first and second assemblies spaced radially outwardly from the shaft and an associated rigid radial extension from the shaft outside the energy chambers, each respective coupling means including means permitting oscillatory movement of the respective assembly relative to said rigid radial extension and timing means associated with each of the drive coupling means to assure a predetermined phasing in the movement of the movable walls relative to one another such that an integral number of oscillatory cycles occurs each full revolution of each movable wall, whereby each said coupling means is arranged to accommodate out-of-phase movements of said movable walls so that said oscillatory movement of said walls does not interfere with transmission of rotational movement of said shaft, and energy from the walls is transmitted directly to the shaft, inlet port means through the housing positioned in a wall of said cylindrical cavity to permit fluid to flow into the successive energy chambers as the walls move apart, and outlet port means through the housing positioned in a wall of said cylindrical cavity to permit fluid to be expelled from the successive energy chambers as the walls close together.

15. A rotary machine construction comprising:

a block providing a cylindrical cavity within and defined by cavity walls, a drive shaft supported on the block coaxially within the cavity to permit rotation of said shaft, parallel edge walls within said cavity axially spaced apart from one another and extending to the cavity wall, rotatable relative to said drive shaft but designed to rotate with it, and defining between them the bounds of energy chambers, an even number of outwardly directed, imperforate movable walls extending to the cavity walls between said parallel edge walls, with alternate movable walls connected to move with one edge wall to form a first wall assembly and intermediate movable walls connected to move with the other edge wall to form a second wall assembly, to form essentially separate and non-intercommunicating energy chambers between said movable walls, which are rotatable about the axis of said shaft, the unattached end of each movable wall maintaining sliding contact with the edge walls with which it does not move, inlet port means through said block into the cylindrical cavity positioned for admitting fluid into each of the successive energy chambers when their respective movable walls start to separate to permit flow from the inlet port means into each of the energy chambers in sequence, outlet port means through said block from the cylindrical cavity positioned for permitting escape of spent fluid from each of the successive energy chambers when their respective movable walls begin to close together to cause flow from the energy chambers into outlet port means, and separate drive coupling means outside the energy chambers respectively connecting each wall assembly at a point spaced radially outward from the shaft to the drive shaft through an associated rigid radial extension from the shaft, each coupling means including means permitting oscillatory movement of its wall assembly relative to said rigid radial extension and timing means associated with each of the drive coupling means to assure a predetermined phasing in the movement of the movable walls relative to one another such that an integral number of oscillatory cycles occurs each full revolution of each movable wall, for accommodating the oscillating movement of the movable walls and for driving the drive shaft, the periodic oscillatory movement of each wall assembly constituting an integral number of full position changes per revolution.

16. The rotary machine construction of claim 15 in which at least one of the inlet and outlet port means includes structure on the block permitting said at least one of the port means to be moved to different positions circumferentially relative to the cylindrical cavity.

17. The rotary machine construction of claim 16 in which at least one of the inlet and outlet port means is provided through a separate arcuate member circumferentially mating with the rest of the block to preserve a smooth cylindrical contour along the face of the cylindrical cavity and providing connection from said port to fluid channels through the block in various circumferential positions and in which means is provided to secure said separate arcuate member in selected positions.

18. The rotary machine construction of claim 17 in which both ports are provided through similar arcuate members.

19. The rotary machine construction of claim 17 in which said at least one of the port means is provided in separate arcuate members in the form of a ring coaxial with the cylindrical chamber and mating with the block in such a way that relative circumferential rotation is possible.

20. The rotary machine construction of claim 19 in which at least one of the inlet and outlet port means is provided in the bottom of an outwardly U-shaped opening channel at least over part of the circumference of said ring, with the open side of which channel the fluid channels through the block communicate.

21. The rotary machine construction of claim 19 in which the ring providing the port means carries a rack element at least part of the way around its circumference, which rack is engaged by pinion drive means rotatable on the block which repositions the port means circumferentially and aids in maintaining the selected position.

22. The rotary machine construction of claim 21 in which both the inlet and outlet ports have ring structures with separate pinions to drive their respective rack elements and each ring being an outwardly opening channel over at least part of its circumference with its port means through the bottom of said channel and the open side of the channel in communication with its associated fluid channel through the block.

23. The rotary machine constuction of claim 15 in which the block providing the cylindrical cavity is composed of pieces which are removably secured together in order to permit the assembly of the internal structure within the cylindrical cavity.

24. The rotary machine construction of claim 23 in which the cylindrical cavity defining a portion of the block comprises at least one cylindrical section and at least one removable end section through which the drive shaft and the rotatable structure as a whole may be assembled into an operable position.

25. The rotary machine construction of claim 24 in which both end sections are similar pieces, each removable from a cylindrical portion and each carrying bearings and a portion of the coupling means.

26. The rotary machine construction of claim 15 in which the imperforate movable walls are generally wedge-shaped in circumferential cross-section and of outward diverging form.

27. The rotary machine construction of claim 26 in which the movable walls are provided with sealing means at least at the outer edges to sealingly engage the cylindrical cavity of the block.

28. The rotary machine construction of claim 27 in which multiple sealing means are provided at the outer edges of each movable wall.

29. The rotary machine construction of claim 26 in which the movable walls are formed of resinous material and sealing means is provided at the outer edge as an integral resilient deformable resinous portion which extends into and is deformed by the cavity wall.

30. The rotary machine construction of claim 15 in which the portion of the coupling means permitting oscillatory movement includes timing means properly timing the oscillations so that rotation proceeds smoothly at an essentially constant rate of speed.

31. The rotary machine construction of claim 30 in which each coupling means consists of similar force transmitting and direction-changing elements between the shaft and each of the wall assemblies, including a crank means between the rigid radial extension of the shaft and the wall assembly, including a translational slide element in the radial direction in one of the elements interconnected by the crank means permitting relative oscillatory movement of the movable walls relative to the shaft.

32. The rotary machine construction of claim 31 in which the connection between the shaft extension and the movable wall assembly involves a crank element having parallel pin portions parallel to the axis of the shaft and a rigid connection therebetween, one of which pins is rotatably supported in one of the connected members and the other of which pins moves in a radial slot in the other member connected by the crank so that one pin portion of the crank effectively revolves about the axis of the other pin portion in order to produce the relative oscillatory movement.

33. The rotary machine construction of claim 32 in which the rotatable supported pin portion is in the rigid radial extension of the shaft and the slot is provided in the movable wall assembly.

34. The rotary machine construction of claim 33 in which the pin portion riding in the slot is provided with a rotatable bearing portion snugly engaged in the slot.

35. The rotary machine of claim 33 in which the crank structure is provided by an eccentric one pin of which provides the central shaft of the eccentric rotatably supported in the radial extension of the shaft.

36. The rotary machine construction of claim 35 in which the central shaft of the eccentric is also provided with a timing member providing a planetary element cooperable with a fixed element on the block which induces revolution of the timing member and the eccentric about the shaft relative to the fixed element on the block.

37. The rotary machine construction of claim 30 in which the timing means consists of at least a planetary gear on a radial extension of the drive shaft cooperable with a stationary gear on the housing.

38. The rotary machine construction of claim 37 in which the gear on the housing is a sun gear about which the planetary gear rides.

39. The rotary machine construction of claim 38 in which a plurality of planetary gears are provided located symmetrically around the shaft on other radial extensions thereof at the same radius to cooperate with the same sun gear.

40. The rotary machine construction of claim 39 in which each of the planetary gear shafts also carries a crank element having a parallel pin offset from the planetary gear shaft and engaged in a slot having a radial component in an element coupled to at least one of the movable walls.

41. The rotary machine construction of claim 40 in which two planetary gear crank assemblies are provided located diametrically opposite one another across the shaft at the same end of the movable walls and engaged in portions of the same movable wall assembly.

42. The rotary machine construction of claim 41 in which two movable walls are provided in each assembly and the sun gear is provided with twice as many teeth as each planetary gear.

43. The rotary machine construction of claim 42 in which the cranks are eccentrics supported on one of two diammetrical arms at opposite ends of the movable walls and an offset drive pin of each eccentric rides in a slot diametrically opposite the slot for the pin of the other eccentric on the same diammetrical arm.

44. The rotary machine construction of claim 43 in which the drive pin engaging slots extend through the edge walls into the movalbe walls and the pins in the slots are provided with suitable bearings which are snugly engaged by the walls of the slots and are rotatable relative to the drive pins.

45. A rotary engine construction comprising:

a block providing a cylindrical cavity within and defined by cavity walls, a drive shaft supported on the block coaxially within the cavity to permit rotation of said shaft, parallel edge walls within said cavity axially spaced apart from one another and extending to the cavity wall, rotatable relative to said drive shaft but designed to rotate with it, and defining between them the bounds of energy chambers, an even number of outwardy-directed imperforate movable walls extending to the cavity walls between said parallel edge walls, with alternate movable walls connected to move with one edge wall to form a first wall assembly and intermediate movable walls connected to move with the other edge wall to form a second wall assembly, to form essentially separate and non-intercommunicating energy chambers between said movable walls, which are rotatable about the axis of said shaft, the unattached end of each movable wall maintaining sliding contact with the edge wall with which it does not move, fuel inlet port means through said block into the cylindrical cavity positioned for admitting fuel into each of the successive firing chambers when their respective movable walls start to separate to permit flow from the inlet port means into each of the energy chambers in sequence, exhaust outlet port means through said block for permitting escape of exhaust after the fuel has been burned from each of the successive energy chambers when their respective movable walls begin to close together to cause flow from the energy chamber into the outlet port means, and separate drive coupling means outside the energy chambers respectively connecting each wall assembly at a point spaced radially outward from the shaft to the drive shaft through an associated rigid radial extension from the shaft, each coupling means including means permitting oscillatory movement of its wall assembly relative to said rigid radial extension, and timing means associated with each of th drive coupling means to assure a predetermined phasing in the movement of the movable walls relative to one another such that an integral number of oscillatory cycles occurs each full revolution of each movable wall, for accommodating the oscillating movement of the movable walls and to drive the drive shaft, the periodic oscillatory movement of each wall assembly constituting an integral number of full position changes per revolution.

46. The rotary engine of claim 45 in which firing means is supported on the block so as to lie within an energy chamber after the inlet port means and before the outlet port means in the direction of rotation of the movable walls.

47. The rotary engine of claim 46 in which the coupling means includes a crank between a radial arm extension of the shaft and the movable wall assembly, said crank having a drive pin radially offset from a support shaft rotatably held by the arm, whereby in certain postions force may be directly transmitted from the movable wall assembly through said crank to the arm.

48. The rotary engine of claim 47 in which the rotatable shaft in the arm is coupled to timing means which essentially determines the rate of rotation of the shaft and resists allowing a force to move the arm faster than the timing will permit.

49. The rotary engine of claim 48 in which the timing means is gears, including a planetary gear on the rotatable crank shaft and a gear fixed to the housing.

50. The rotary engine of claim 47 in which the crank is an eccentric.

51. The rotary engine of claim 46 in which each of the coupling means employs a crank to connect the rigid radial extension to the movable wall assembly, the crank rotating about a pin supported in the rigid radial extension of the shaft which provides a gear axle carrying a planetary gear and a parallel pin engaged in a slot having a radial component in the wall assembly and a sun gear fixed to the block coaxially of the drive shaft around which the planetary gear runs in order to cause the rotational action of the shaft and the crank.

52. The rotary engine of claim 51 in which the selected gear ratio is selected to produce an even number of full oscillation of the movable walls relative to the cylindrical drive shaft for each revolution of the shaft.

53. The rotary engine of claim 51 in which similar coupling means is provided for each movable wall assembly but out of phase such that the movable walls cycle an even number of full cycles toward and away from each other for every revolution of the cylindrical drive shaft.

54. The rotary engine of claim 53 in which there are two movable walls associated with each edge wall to move with it and coupling means are located 90° out of phase with one another and each produces two full oscillations of their movable walls for each rotation of the shaft.

55. The rotary engine of claim 51 in which the radial extensions of the drive shaft extend in diametrically opposite directions away from the shaft and provides two identical planetary gear shafts each supporting identical planetary gears at the same radius from the axis and each providing identical cranks to produce identical movement of the edge wall and its associated movable walls.

* * * * *

UNITED STATES PATENT OFFICE
CERTIFICATE OF CORRECTION

Patent No. 4,068,985 Dated January 17, 1978

Inventor(s) John S. Baer

It is certified that error appears in the above-identified patent and that said Letters Patent are hereby corrected as shown below:

Column 3, line 63, "outer" should be --other--;
line 65, "movble" should be --movable--;
Column 4, line 8, "their" should be --there--;
Column 5, line 12, after "52b" insert --supported by arm 46--;
line 13, after "drive" delete --eccentric--;
line 14, before "crank" insert --eccentric--;
line 16, after "drive" delete --eccentric--;
line 17, after "on" insert --eccentric--;
line 33, change "72" to --72b--;
Column 6, line 61, "88" should be --98--;
line 66, change "68a, 70a" to --78a, 80b--;
Column 7, line 61, "maximum" should be --maxim--;
Column 8, line 33, "arm" should be --pin--;
line 43, "patter" should be --pattern--;
line 67, "generaly" should be --generally--;
Claim 8, line 2, after "port" insert --means--;
Claim 44, line 3, "movalbe" should be -movable--;
Claim 45, line 11, "outwardy" should be --outwardly--;
line 34, "energy" should be --firing--;
line 67, "th" should be --the--;
Claim 47, line 6, "postions" should be --positions--.

Signed and Sealed this

*Twenty-third* Day of *May 1978*

[SEAL]

*Attest:*

RUTH C. MASON
*Attesting Officer*

LUTRELLE F. PARKER
*Acting Commissioner of Patents and Trademarks*